United States Patent [19]

Shibata et al.

[11] Patent Number: 4,580,947

[45] Date of Patent: Apr. 8, 1986

[54] METHOD OF CONTROLLING OPERATION OF A PLURALITY OF COMPRESSORS

[75] Inventors: Yozo Shibata; Mitsuji Konishi, both of Hitachi, Japan

[73] Assignee: Hitachi, Ltd., Tokyo, Japan

[21] Appl. No.: 689,071

[22] Filed: Jan. 4, 1985

[30] Foreign Application Priority Data

Jan. 11, 1984 [JP] Japan ..... 59-2005

[51] Int. Cl.[4] ..... F04B 49/02; F04B 49/06; F04B 41/06

[52] U.S. Cl. ..... 417/8; 417/38; 417/53

[58] Field of Search ..... 417/2-8, 417/38, 53

[56] References Cited

U.S. PATENT DOCUMENTS 4,502,842 3/1985 Currier et al. ..... 417/53

FOREIGN PATENT DOCUMENTS 48310 10/1983 Japan ..... 417/5

*Primary Examiner*—William L. Freeh

*Attorney, Agent, or Firm*—Antonelli, Terry & Wands

[57] ABSTRACT

Disclosed is a method of controlling the operation of a plurality of compressors each having at least one capacity controller capable of changing the discharge rate of the compressor in a stepped manner in such a manner as to provide a total discharge rate just meeting the load demand which varies momentarily. In this method, the control system is divided into a capacity control loop for responding to comparatively small load variance and a compressor control loop for responding to a comparatively large load variance. The capacity control loop is further divided into a sub-loop for capacity controllers of a compressor which has worked longest and which is to be stopped first and a sub-loop for the capacity controllers of other compressors. The unloading operation is commenced preferentially with the sub-loop for the capacity controllers of the compressor to be stopped first, while the on-loading operation is made first with the sub-loop for the capacity controllers of other compressors.

7 Claims, 10 Drawing Figures

FIG. 6

| COM-PRESSORS | MODE / CAPACITY CONTROLLER (PRESSURE LEVEL) | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| | | L2 | L1 | L2 | L1 | L2 | L1 | H1 | H1 | H1 | L1 | H2 | H1 | H1 | H1 | H1 | L1 | L1 | L1 | H1 | H2 | H1 | L1 | L2 |
| C1 | V1 | △ | ○ | ○ | ○ | △ | ○ | ○ | △ | △ | △ | × | × | × | × | × | × | × | × | × | × | × | × | ○ |
| | V2 | ○ | ○ | △ | ○ | ○ | ○ | △ | △ | △ | △ | × | × | × | × | × | × | × | × | × | × | × | × | ○ |
| C2 | V1 | × | × | ○ | ○ | ○ | ○ | ○ | ○ | △ | ○ | ○ | ○ | △ | △ | △ | △ | △ | △ | △ | × | × | × | × |
| | V2 | × | × | ○ | ○ | ○ | ○ | ○ | ○ | ○ | ○ | ○ | △ | △ | △ | △ | △ | △ | ○ | △ | × | × | × | × |
| C3 | V1 | × | × | × | × | ○ | ○ | ○ | ○ | ○ | ○ | ○ | ○ | ○ | △ | △ | ○ | ○ | ○ | ○ | ○ | △ | ○ | ○ |
| | V2 | × | × | × | × | ○ | ○ | ○ | ○ | ○ | ○ | ○ | ○ | ○ | ○ | △ | △ | ○ | ○ | ○ | ○ | ○ | ○ | △ |

( ×:STOP ○:ON-LOAD △:UNLOAD )

FIG. 9
PRIOR ART

| COM-PRESSORS | PRESSURE LEVEL / MODE / CA-PACITY CONTROLLER | 1 | 2 | 3 | 4 | 5 | 6 | 7 | 8 | 9 | 10 | 11 | -- | 100 | 101 | 102 | 103 | 104 | 105 | 106 | 107 | 108 | 109 | 110 |
|---|---|---|---|---|---|---|---|---|---|---|---|---|---|---|---|---|---|---|---|---|---|---|---|---|
| | | L2 | L1 | L2 | L1 | L2 | L1 | H1 | H1 | L1 | H1 | L1 | | H1 | L1 | H1 | H2 | L1 | L1 | L1 | L1 | L2 | H2 | |
| No. 1 | V11 | ○ | ○ | ○ | ○ | ○ | ○ | △ | △ | ○ | ○ | ○ | | ○ | ○ | ○ | × | × | ↓× | × | × | ○ | ○ | |
| | V12 | △ | ○ | ○ | ○ | ○ | ○ | ○ | △ | △ | △ | ○ | | △ | ○ | ○ | × | × | × | ↓× | × | ○ | ○ | |
| No. 2 | V11 | × | × | ○ | ○ | ○ | ○ | ○ | ○ | ○ | △ | △ | | ○ | ○ | △ | △ | △ | △ | △ | ○ | △ | × | |
| | V12 | × | × | △ | ○ | ○ | ○ | ○ | ○ | ○ | ○ | ○ | | ○ | ○ | ○ | ○ | ○ | ○ | ○ | ○ | ○ | × | |
| No. 3 | V11 | × | × | × | × | ○ | ○ | ○ | ○ | ○ | ○ | ○ | | ○ | ○ | ○ | ○ | ○ | ○ | ○ | ○ | ○ | ○ | |
| | V12 | × | × | × | × | △ | ○ | ○ | ○ | ○ | ○ | ○ | | △ | △ | △ | △ | ○ | ○ | ○ | ○ | ○ | ○ | |

( ×:STOP ○:ON-LOAD △:UNLOAD ↓:SKIPPING )

METHOD OF CONTROLLING OPERATION OF A PLURALITY OF COMPRESSORS

BACKGROUND OF THE INVENTION

The present invention relates to a method of and an apparatus for controlling the operation of a compressor system having a plurality of compressors connected in parallel, each having the function of changing its capacity. More particularly, the invention is concerned with a method of and an apparatus for controlling the capacities of the compressors and the number of compressors taking part in the parallel running in accordance with changes in the load.

Compressed fluids such as air are used as the power source in various facilities such as a machine or chemical plant, civil engineering or construction sites, and so forth. Usually, in such a use, the composition or supply rate of the compressed fluid, i.e., the load level, changes widely. In order to fulfill the demand for a wide variation in the load level, the system for supplying the compressed fluid usually has a plurality of compressors connected in parallel and having a total capacity large enough to meet the maximum load demand, and the total discharge rate is changed in accordance with changes in the load level while maintaining a constant fluid pressure, thus economizing on the consumption of power. Basically, this control is achieved mainly in either one of the following two ways: a number control method in which the number of compressors taking part in the parallel running is controlled to meet the varying load demand, and a pressure control method in which the discharge rates, i.e., the capacities of the compressors, are controlled by controlling the operation of capacity controllers associated with respective compressor in accordance with changes in the load. The first-mentioned method is disadvantageous in that the rate of supply of the fluid is drastically changed in a non-linear manner because the control is made in a rather rough manner by changing the number of compressors taking part in the operation and also in that the supply rate cannot be changed quickly following the load variation due to various restrictions concerning the starting and stopping of the compressors. The second-mentioned method also suffers from disadvantages such as heavy wear of the capacity controllers and a resulting reduction in efficiency, as well as shortening of the life of compressors, due to partial load operation of all compressors.

In view of the above, it is preferable to combine these two types of controlling method. To this end, hitherto, it has been practiced to adopt separate loops: namely, a capacity control loop for controlling the capacities of the compressors and a compressor control loop for controlling the number of compressors taking part in the operation. In operation, the capacity control loop serves to comply with comparatively small changes in the load demand, while the compressor control loop is used when the load changes rather drastically. This combined system, however, tends to cause a hunting of the control system because of lack of communication between the two loops. Consequently, the frequency of controlling changes tends to be increased, which shortens the life of the capacity controllers and the compressors themselves.

In Japanese Patent Publication No. 30990/1982, a control system having a combination of the compressor control method and the pressure control method is proposed by inventors some of whom are also inventors of the present application. According to this control system, the compressors are put into operation in a sequence and are put out of operation in the same sequence. That is, the compressor which has worked longest of the compressors under operation is scheduled to be the one first stopped when a stopping instruction is given. When a decrease in the load is comparatively small, the capacity is reduced in a stepped manner only in the compressor which is due to be stopped first, while the other compressors are operated at full load, whereas, when the reduction of the load is large, the compressor due to be stopped first is stopped without delay. In this control system, the compressor control loop and the capacity control loop are related to each other to meet varying load demands, but the requirement for a delicate control of the supply rate is not fully met because the capacity control is made in a stepped manner in only one compressor.

Under these circumstances, there is an increasing demand for a method of controlling the operation of compressor which permits a control of the rate of supply of the fluid in a delicate manner and over a wide range, while suppressing the wear of the capacity controllers and prolonging the life of the compressors.

SUMMARY OF THE INVENTION

Accordingly, an object of the invention is to provide a method of controlling the operation of compressor in which the undersirable hunting of the control system is avoided by synchronization of operation as between the compressor control loop and the capacity control loop.

Another object of the invention is to provide an apparatus for controlling the operation of compressors, which can efficiently control the operation of compressors with a simple construction by synchronization of operation as between the compressor control loop and the capacity control loop.

To this end, according to the invention, there is provided a method of controlling the operation of a plurality of compressors the capacities of which are controllable in a stepped manner, wherein the control system has a compressor control loop and a capacity control loop, and the capacity control loop is further divided into a first loop for controlling a compressor which is to be stopped first and a second sub-loop for controlling the other compressors. The unloading is conducted first by the first sub-loop for controlling the compressor due to be stopped while the on-loading is conducted first by the second sub-loop for the other compressors.

BRIEF DESCRIPTION OF THE DRAWINGS

The invention will be described hereinunder in more detail with reference to the accompanying drawings in which:

FIG. 6 is a table illustrating the control operation mode of the apparatus shown in FIG. 1;

FIG. 9 is a table showing the controlling operation mode in accordance with a conventional controlling method.

DESCRIPTION OF THE PREFERRED EMBODIMENT

Figure 1:
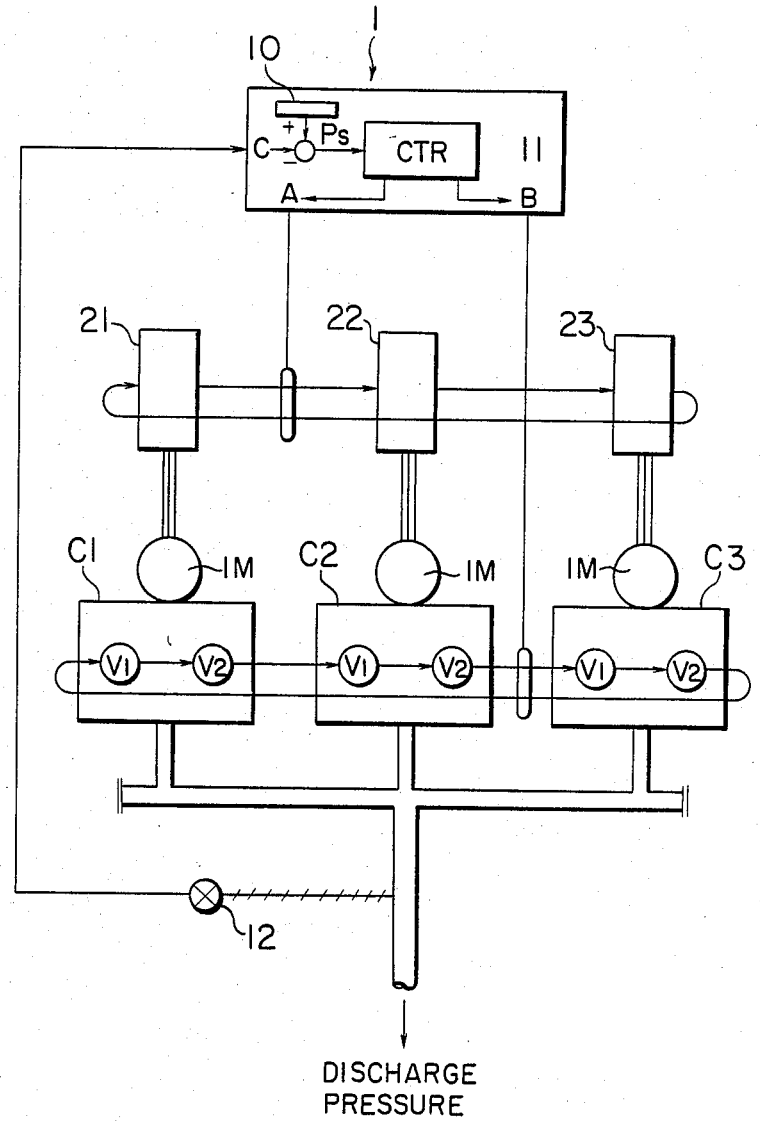
FIG. 1 is an illustration of an example of a compressor for carrying out the controlling method of the invention.

FIG. 1 shows an example of an apparatus for carrying out the controlling method in accordance with the invention. For the purpose of simplifying the explanation, it is assumed here that the compressor system controlled by the method of the invention has three compressors $C_1$, $C_2$ and $C_3$ which are connected in parallel. It is also assumed here that each of the compressors $C_1$, $C_2$ and $C_3$ are the reciprocating type of compressors each having capacitor controllers $V_1$ and $V_2$, although other types of compressors are usable, provided that they have the function of controlling the capacities thereof. The compressors $C_1$, $C_2$ and $C_3$ are drivingly connected to driving motors IM and these driving motors are connected to starter panels 21, 22 and 23, respectively. At the same time, the discharge ports of the compressors are connected in parallel to one another and merge in a common pipe through which compressed fluid such a high pressure air is supplied to the load. Although not shown in FIG. 1, a suitable arrangement is made for supplying the compressors with the fluid to be compressed.

An automatic control system 1 includes a setter 10 for setting the command control pressure, controller 11 and a pressure transmitter 12. The pressure transmitter 12 is connected to the common supply pipe downstream of the compressors, and is adapted to convert the discharge pressure of the compressors into an electric signal and to deliver this electric signal to an input terminal C of the control system 1 through a signal line. The pressure signal delivered to the input terminal C is compared with a command control pressure Ps which is set beforehand in the setter 10 and a signal representing the difference is inputted to the controller 11. When the load variance is comparatively small, an on-load instruction or an unload instruction is given as the capacity controlling instruction B to the respective capacity controllers $V_1$ and $V_2$ of the compressors $C_1$ to $C_3$. However, when the load variance is so large that it cannot be met by control of the capacities of the working compressors, or when the load is changed by an amount in excess of the total capacity of one compressor, the controller 11 delivers a starting instruction or a stopping instruction as a compressor control instruction A. This instruction A is delivered to the starter panels 21 to 23 of the compressors $C_1$ and $C_3$.

The following four stages (see FIG. 7) of command control pressure as predetermined:

$L_1$: on-load instruction set level $L_2$: starting instruction set level $H_1$: unload instruction set level $H_2$: stopping instruction set level The control in response to small load variance over the levels $L_1$ and $H_1$ but within the levels $L_2$ and $H_2$ is undertaken by the capacity control instruction B, while the control for large load variance over the levels $L_2$ and $H_2$ is undertaken by the compressor control instruction A.

The control loop which controls the compressors in accordance with the control instruction is composed of a capacity control loop for controlling the capacity controllers $V_1$, $V_2$ of three compressors and a compressor control loop for controlling the number of compressors taking part in the operation. According to the invention, the capacity control loop is further divided into two sub-loops: namely, a first sub-loop for managing the capacity controllers $V_1$, $V_2$ of the compressor which is due to the stopped first and a second sub-loop for managing the capacity controllers $V_1$, $V_2$ of the other compressors.

The compressor loop performs an endless control which starts and stops compressors in a predetermined order or sequence, e.g., firstly the compressor $C_1$, secondly the compressor $C_2$ and finally the compressor $C_3$. Namely, in this embodiment, compressors $C_1$, $C_2$ and $C_3$ are put into operation in the above-mentioned order from the stopping condition and, when it is judged that one of the compressors should be stopped, the compressor $C_1$, which has worked longest, is selected as the compressor which is to be stopped first. When the compressor $C_1$ is stopped due to rise of the discharge pressure to a level above the set level $H_2$, the compressor $C_2$ which has worked longest in the working compressor is selected as the compressor due to be stopped. Then, when the discharge pressure is decreased to a level below the set value $L_2$, the compressor $C_1$ which has been stopped longest is put into operation again. The selection of the compressor to be stopped first is made by an operation control circuit in the controller 11.

Figure 2:
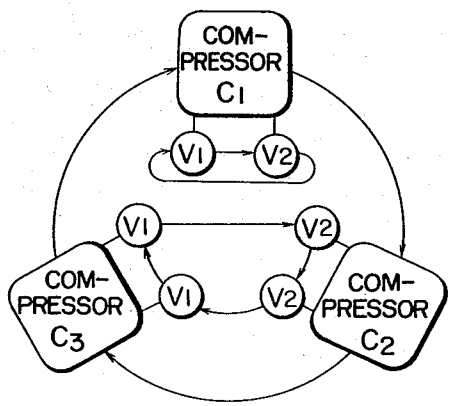
FIGS. 2 and 3 are schematic illustrations explanatory of the control loops incorporated in the apparatus shown in FIG. 1.

FIG. 2 shows a control loop which is formed when the compressor $C_1$ has been selected as the compressor to be stopped first. It will be seen that the sub-loop for the capacity control of the compressor $C_1$ is separated from the sub-loop for capacity control of the other compressors $C_2$ and $C_3$.

In this case, the sub-loop for the compressor $C_1$ is first put into operation so that, when the discharge pressure is increased above the set level $H_1$, the unloading is effected preferentially on the compressor $C_1$ which is to be stopped first. Conversely, when the discharge pressure comes down below the set level $L_1$, the sub-loop for capacity control of other compressors $C_2$, $C_3$ is first put into operation so that the on-load control is made preferentially on the compressors $C_2$ and $C_3$. This capacity control instruction is given by a capacity control circuit in the controller 11 in accordance with the selection of the compressor to be stopped which is made by the operation control circuit. In addition, the preference or order in each capacity control sub-loop is determined as indicated by arrows in FIG. 2. That is, the unloading control is commenced first with the capacity controller which has worked longest, while the on-load control is made with the capacity controller which has been suspended longest.

Figure 3:
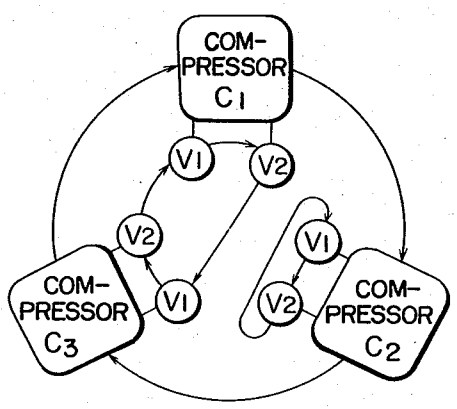

FIG. 3 shows the control loops formed when the compressor $C_2$ has been selected as the compressor to be stopped first. In this case, the capacity control is made in the same manner as that explained before in connection with FIG. 2.

In FIGS. 2 and 3, the capacity control sub-loops for the compressors $C_1$ and $C_2$, respectively, are shown as being separated from the capacity control loops of the other compressors, for the sake of simplicities. However, the actual loop construction may be such that the capacity controllers of all compressors are operated in a predetermined order, and the isolation of the capacity control sub-loop for the compressor to be stopped first is made only conceptionally as a matter of control processing in the controller 11.

The automatic control system 1 has, in addition to the above-mentioned control circuits, several counter circuits which are adapted to measure the timer lengths or periods for the confirmation of the effect of on-loading, effect of unloading, effect of starting, effect of stopping and restriction on stopping.

The period for confirming the effects of on-loading and unloading are the time lengths which are set beforehand to allow communication of the effect of on-loading or unloading by one capacity controller through observation of the increase or decrease of the discharge pressure resulting from such an on-loading or unloading operation, thereby preventing the next capacity controller from being put into effect unnecessarily.

The period for confirmation of the effects of starting and stopping are the time lengths which are set in regard to the start and stop of a compressor within the same concept as that for the above-mentioned on-loading and unloading effect confirmation period. In this case, however, consideration is given to the time length which is required in connection with the operation of the compressor, as will be detailed later.

In general, the starting and stopping effect confirmation period is selected to be 40 to 60 seconds, while the on-loading and unloading effect confirmation period is about 10 to 15 seconds. Time periods within the mentioned range may be adapted also in the control system of this example.

The stop limiting period is the time length for which the compressor is forced to operate after the start up thereof. This measure is taken in order to ensure the cooling of the motor which has been heated up during the start-up by the large electric starting current. In this control system 1, this stop limiting period is set to be 30 minutes, as in the case of the conventional system.

In the automatic control system 1 in accordance with the invention, the counter circuits for the measurement of the effect confirmation periods are maintained in the stand-by condition with the set time periods elasped after respective counting operations so that they may put the associated control equipments immediately into operation in response to the load variation. These counter circuits are reset and start to count the time length in response to respective instructions.

The operation of the automatic control system 1 having the construction described hereinbefore will be explained in connection with FIGS. 4 and 5.

Figure 4:
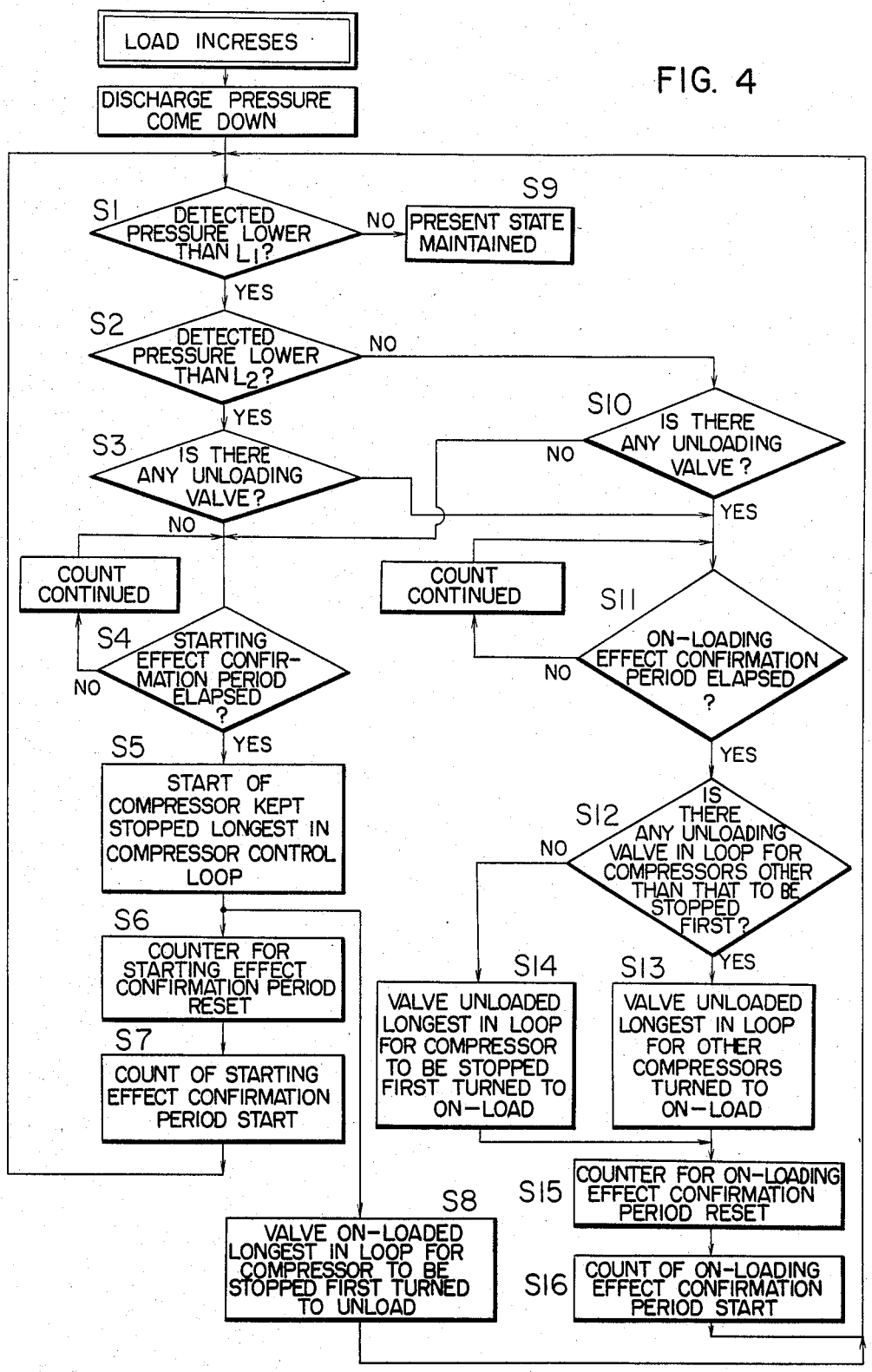
FIGS. 4 and 5 are flow charts illustrating the control processing performed by the apparatus shown in FIG. 1.
Figure 5:
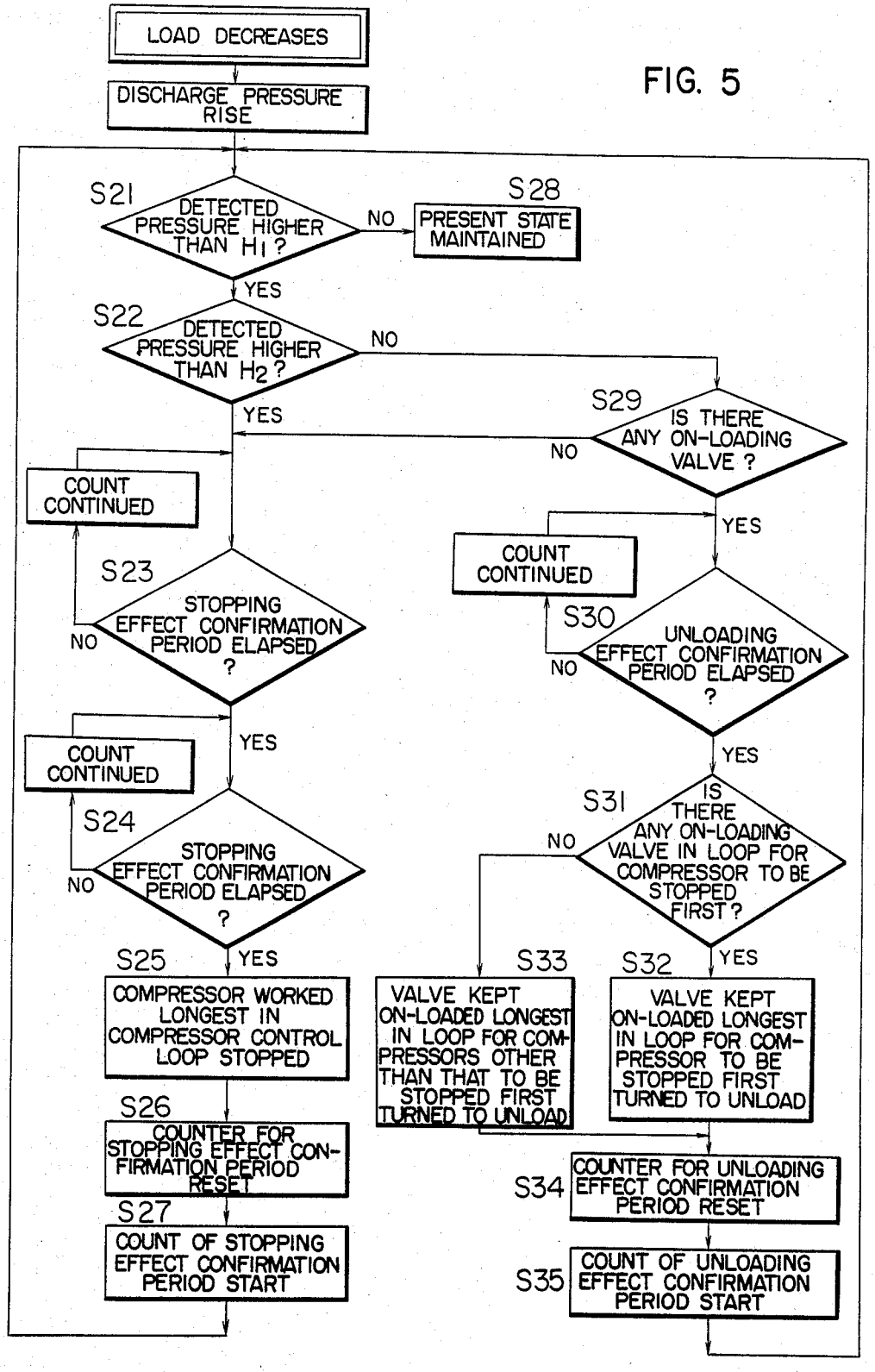

FIG. 4 is a flow chart of the control which is conducted in response to an increment in the load. Assuming here that the load is increased gradually from the state in which the discharge rate balances the load demand, the discharge pressure is gradually decreased because of the shortage of the discharged fluid. If the pressure signal converted by the pressure transmitter 12 exceeds the set level $L_1$ which constitutes the on-load instruction, a result "NO" is obtained in the judgement conducted in step S1. In consequence, the process proceeds directly to a step S9 so that no control instruction is given and the present state of the compressor system is maintained.

When the pressure signal comes down below the set level $L_1$, "YES" is obtained as a result of the judgement performed in the step S1, so that the process proceeds to a step S2. If the level of the pressure signal is between the set levels $L_1$ and $L_2$, an answer "NO" is obtained as a result of the judgement conducted in the step S2, so that the process proceeds to a step S10. In the step S10, a judgement is made as to whether there is a capacity controller, i.e. valve, which is in the unloading condition in the working compressors. If the answer is "YES", the process proceeds to a step S11. However, if the answer is "NO", the process proceeds to a step S4 for control of the number of working compressors.

In the step S11, a judgement is made as to wether or not the on-loading effect confirmation period has elapsed. If the answer is "NO", the process waits for the elapse of the effect confirmation period. Conversely, if the answer is "YES", the process proceeds to a step S12. In order to ensure that the capacity controller of the compressor to be stopped first is operated last, a judgement is made in the step S12 as to whether there is any unloading valve in the capacity control sub-loop for the remaining comporessors. If there is an unloading valve in the capacity control sub-loop for the other compressors, an answer "YES" is obtained as a result of the judgement performed in the step S12, and the process proceeds to a step S13. In this step S13, an instruction is given to operate the valve which has been maintained in the unloaded state longest into the on-loading state. Conversely, when there is no unloaded valve in the sub-loop for compressors other than that to be stopped first, an answer "NO" is obtained in the step S12 and the process proceeds to a step S14. In the step S14, the valve in the capacity control sub-loop for the compressor to be stopped first, which has been in the unloaded state longest, is turned to the on-load state thereby increasing the discharge rate. Simultaneously with the execution of the step S13 or the step S14, the process proceeds to a step S15 in which an operation is made whereby the counter circuit is reset so as to measure the on-loading effect confirmation period. Then, after re-starting the counting of the time in a step S16, the process is returned to the step S1.

Thus, when the load demand increases, a series of judgement is made through the steps S12 to S14 such that the valves in the capacity control sub-loop for the compressors other than the compressor to be stopped first are preferentially turned into the on-loading state and, after all of these valves are turned to the on-loading state, the control loop is changed to the capacity control sub-loop for the compressor to be stopped first so as to successively turn the valves of this compressor into the on-loading state.

After returning to the step S1, when the discharge pressure is still below the set level $L_1$, the process repeats the above-mentioned operation through the steps S2, S10 and S11. If the on-loading effect confirmation period has expired, the process proceeds to the step S12 so as to turn an additional valve into the on-loading state. If the counting is being conducted due to the resetting of the counting circuit in the above-explained operation of step S15, an answer "NO" is obtained as a result of the judgement made in the step S11, so that the counting of the time is continued. During this counting, if the discharge pressure recovers to a level exceeding the set level $L_1$ as a result of the latest on-loading of the valve, the automatic control system 1 maintains its present state and is held in the stand-by state.

When the discharge pressure has come down below the starting set level $L_2$ as a result of a further increase in the load, the process proceeds from the step S1 past the step S2 to a step S3. In the step S3, a judgement is made as to whether there is any valve in the unloaded state in the working compressors. This judgement is made in consideration of the fact that the recovery of the discharge can be made more quickly by turning the unloaded valves into the loaded sate than by starting a new compressor. In addition, using the result of this judgement, it is possible to minimize unnecessary starting of a new compressor.

In general, starting up a compressor with 100% load imposed thereon causes an overload on the driving moror IM, often resulting in an overheating or burning down of the motor due to overcurrent. To avoid this problem, it is a common measure to reduce the load to 0% when the compressor is started. Usually, the compressor operates with 0% load for a period of about 10 seconds until the operating condition is settled after the start up.

On the other hand, the time length required for turning a valve from the unloaded state to the loaded state varies depending on the state during the on-loading effect confirmation period. According to the invention, however, the valve can usually turned into the loaded state immediately because the counter circuit is held in the stand-by condition after the expiration of this period. For this reason, the recovery of the discharge pressure is made more quickly by turning the valves from unloaded state to the loaded state than by starting up additional compressor.

In the step S3, when there is al least one valve in the unloaded state, an answer "YES "YES" is obtained and the process proceeds to a step S11. Then, operation is repeated in the same manner as that conducted when the discharge pressure is below the set level $L_1$, so that the number of valves in the loaded state is increased to enhance the discharge rate. Conversely, when there is no valve in the unloaded condition, an answer "NO" is obtained in the step S3 so that the process proceeds to a step S4. As explained before, the counter circuit for the starting effect confirmation period is normally held in the stand-by condition after the expiration of the period, so that the answer "YES" is obtained in the step S4 so that the process may proceed to a step S5 unless there is a compressor started already and time counting is being conducted.

In the step S5, a control is made to start up the compressor which has been kept inoperative longest, on the basis of the data concerning the state of operation of the compressor stored in the operation control circuit. After the completion of start up of this compressor, on-loading instructions are given successively to the valves of this compressor. The valves are turned to on-load in response to these instructions so that the started compressor commences operation with 100% load. At the same time, although not shown in FIG. 4, the timer circuit for the on-loading effect confirmation period is reset and starts the counting of time. Then, in a step S6, the counter circuit for the starting effect confirmation period is reset and, in a step S7, this circuit starts the counting. The process then returns to the step S1. In order to avoid any drastic increase in the discharge rate while attaining coincidence between the increment of the discharge rate and the demanded load as much as possible, the valve in the capacity control sub-loop for the compressor to be stoppefirst, which has been in the on-loaded state longest, is turned to the unloaded state in a step S8, simultaneously with the completion of the start up of the compressor, such that the total discharge rate is increased by an amount which corresponds to about 50% of the capacity of one compressor.

An explanation will be made hereinunder as to the case where the load demand is gradually decreased, with specific reference to FIG. 10.

In contrast to the case of an increase in the load demand, a decrease in the load demand causes a rise of the discharge pressure. When the discharge pressure is below the set level $H_1$, a judgement is made in a steps 21 and the process proceeds to a step S28, so that the automatic control system maintains its present state. However, when the discharge pressure has been increased to exceed the set level $H_1$, an answer "YES" is obtained through the judgement in the step S21, so that the process proceeds to a step S22. In the step S22, when the pressure is below the set level $H_2$, an answer "NO" is obtained and the process proceeds to a step S29. In the step S29, a judgement is made as to whether there is any valve in the on-loaded state in the working compressors. If there is any, the process proceeds to a step S30. In the step S30, an answer "YES" is obtained after expiration of the unloading effect confirmation period, and the process proceeds to a step S31. Conversely, if the answer "NO" is obtained through the judgement in the step S29, the process proceeds to a step S23 for effecting the control of the number of compressors because in such a case it is not necessary to maintain all of the working compressors in the operating condition. An explanation of the operation in the step S23 and the following steps will be made later.

In order that the valves in the on-loaded state in the capacity control sub-loop for the compressor to be stopped first may be preferentially turned to the unloaded state, a judgement is made in the step S31 as to whether there is any on-loaded valve in the above-mentioned capacity control sub-loop. An answer "YES" is obtained in the step S31 if there is any on-loaded valve in the capacity control sub-loop for the compressor to be stopped first, and the process proceeds to a step S32. In this step 32, the valve in the above-mentioned capacity control sub-loop, which has been kept in the on-loaded state longest, is turned to the unloaded state.

If there is no on-loaded valve in the above-mentioned capacity control sub-loop, the process proceeds from the step S31 to a step S33. In the step S33, the valve in the capacity control sub-loop for compressors other compressors the compressor to be stopped first, which has been kept in the on-loaded state longest, is turned to the unloaded state to decrease the discharge rate.

After the execution of the operation in the steps S32 and S33, the process proceeds to a step S34 in which the counter circuit for unloading effect confirmation period is reset. Then, after starting the counting operation of this circuit in a step S35, the process returns to the step S21.

As has been described, according to the invention, it is possible to preferentially unload the compressor to be stopped first from among the total number of compressors.

After the process has been returned to the step S21, if the discharge pressure has been increased beyond the stopping instruction set level $H_2$ due to further decrease in the load demand, the process conducted by the automatic control system 1 is continued through the steps S21, S22 and S23. In the step S23, a judgement is made as to whether the stopping effect confirmation period has expired. If this period has expired, the process proceeds from the step S22 to a step S24. In the step S24, a judgement is made as to whether the aforementioned stop limiting period has expired. If the answer is "YES", the process proceeds to a step S25 so that the compressor which has worked longest, i.e., the compressor due to be stopped first, is the one made to stop out of all the compressors. Then, in a step S26, the timer circuit for the stopping effect confirmation period is reset and, in a step S27, this timer circuit starts the counting. The process is then returned to the step S21. In the period in which the discharge pressure is increased from the set level $H_1$ to the set level $H_2$, the compressor due to be stopped first is kept in the unloaded condition, i.e., in the state in which the discharge rate is zero, as a result of the operation executed through the steps S29 to S33. Consequently, no change in the discharge rate is caused by the stopping of this compressor. Thus, the operation explained hereinabove is repeated if the discharge pressure is still higher than the set level H2 when the process has been returned to the step S21.

Thereafter, the operation described heretofore is repeated in accordance with the change in the discharge pressure, i.e., in response to the load demand variation. Description has been made of the controlling processing performed by the automatic control system 1. Such an automatic control system will be suitably realized by a combination of a microcomputer and a relay structure as shown in Japanese Patent Publication No. 30990/1982 mentioned before. The detailed construction of the automatic control system itself, however, is a matter of design choice and, hence, no further discussion is made in this connection. The circuit arrangement for comparing the discharge pressure and the set levels has been proposed already by the present inventors with other co-inventors in Japanese Patent Laid-Open No. 5434/1980.

An explanation will be made hereinunder as to an example of the mode of operation performed by the automatic control system, as well as the relationship between the command pressure and the discharge pressure, with specific reference to FIGS. 6 and 7.

FIG. 6 is a Table showing respective operation modes and the states of operation of the compressors and capacity controllers, i.e., valves, resulted from these operation modes. The mode 1 appearing in this Table shows the state before the commencement of operation. In this state, therefore, no compressor is operating and no valve is in the on-loaded condition, while the discharge pressure is below the starting instruction set level $L_2$. Therefore, the control processing is executed through the steps S1, S2, S3, S4 and S5 of FIG. 4, so that the compressor $C_1$ is started in accordance with the sequence which is set in the operation control circuit in the controller 11. After the start up of the compressor $C_1$, the valve $V_1$ and $V_2$ of the compressor $C_1$ is turned successively into the on-load state in accordance with on-loading instructions. At the same time, the counting for the on-loading effect confirmation period is started. In this mode, since the compressor $C_1$ is the compressor due to be stopped first, and since the valve $V_1$ has been turned into the on-load condition earlier than the valve $V_2$, the valve $V_1$ of the compressor $C_1$ is turned into the unloaded state in the step S8. In consequence, the compressor $C_1$ is made to operate with 50% load. Therefore, the discharge pressure is increased to a certain level below the on-load set level $L_1$, although the discharge rate is still much smaller than the load demand. As a result, the operation mode is shifted to the mode 2 appearing in the Table. In the mode 2, the control processing proceeds through the steps S1, S2, S10 and S11. In addition, since the compressor $C_1$ due to be stopped first has an unloading valve, the process proceeds from the step S12 to the step S14 on condition that the on-loading effect confirmation period has been expired. In the step S14, the valve $V_1$ is turned to the on-load state so that the compressor $C_1$ starts to operate with 100% capacity. In a mode 3, when the discharge pressure again comes down below the set level $L_2$ as a result of a further increase in the load, the process proceeds through the steps S1, S2 and S3. Then, since all valves $V_1$, $V_2$ of the compressor $C_1$ are in the on-load state, the process proceeds from the step S4 to the step S5 on condition that the starting effect confirmation period has expired, so that the compressor $C_2$ commences its operation with 100% capacity. In this state, since the valve $V_2$ of the compressor $C_1$ due to be stopped first has been held in the on-loaded state longer than the valve $V_1$ of the compressor $C_1$, the valve $V_2$ of the compressor $C_1$ is turned into the unloaded state in the step S8.

It will be easy to imagine that the operation mode is changed down to a mode 7, while following a change in the load demand as the controlling process proceeds in the manner explained before in connection with FIG. 4. As will be understood from the state resulting from the control operation of a mode 6, the control mode 7 is commenced when the discharge pressure has been increased beyond the set level $H_1$ with all compressors in the on-loaded condition. In this mode 7, therefore, the control processing as shown in FIG. 5 is conducted through the steps S21, S22, S29, S30, S31 and S32, and the valve $V_2$ of the compressor $C_1$ which is due to be stopped first, and which has been kept in the on-load condition longer than the other valve, is turned to the unloaded state. In the next mode 8, the discharge pressure is still higher than the set level $H_1$, so that the processing is conducted through the steps S21, S22, S29, S30, S31 and S32, as in the case of the mode 7, so that the other valve $V_1$ of the compressor $C_1$ is turned to the unloaded state. All valves $V_1$, $V_2$ of the compressor $C_1$ which is due to be stopped first have been turned to the unloaded state in the mode 8. In the next mode 9, therefore, processing is conducted through the steps S21, S22, S29, S30, S31 and S33, while the valve $V_1$ is made to unload the compressor $C_2$ which is not due to be stopped first.

In the next mode 10, the load is increased again so that the processing is conducted through the steps S1, S2, S10, S11, S12 and S13 shown in FIG. 4, thereby on-loading the valve $V_1$ of the compressor $C_2$ which is not the one to be stopped first. When the operation mode is changed to the next mode 11, i.e., when the discharge pressure has been increased to the level of the stopping instruction set level $H_2$, the steps S21, S22, S23, S24 and S25 in FIG. 5 are executed so that the compressor $C_1$ which has worked longest, i.e., the compressor due to be stopped first, is made to stop its operation. Then, the processing in accordance with the flow charts shown in FIGS. 4 and 5 is conducted down to a operation mode 23. It will be understood that the compressor $C_2$ and the compressor $C_3$ are the compressors which are selected to be stopped first, respectively, in the operation modes 11 to 19 and in the operation modes 20 to 23.

For an easier understanding of the features offered by the invention, a typical conventional controlling method which has been attempted by the present inventors will be explained hereinunder with specific reference to FIGS. 8 to 10.

Figure 8:
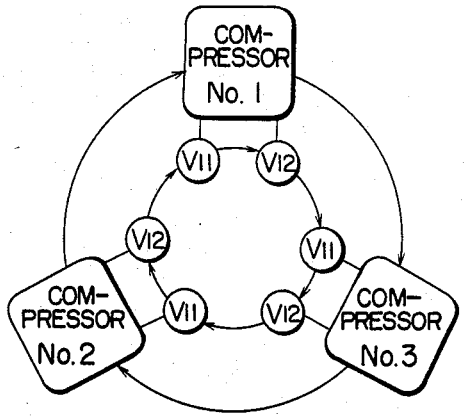
FIG. 8 PRIOR ART
FIG. 8 is a schematic illustration of the control loop performed by the conventional controlling method.

FIG. 8 is a schematic illustration of the control loop used in this conventional controlling method. As in the case of the described embodiment of the invention, it is assumed that this conventional controlling method is applied to the control of operation of three compressors. This conventional controlling method employs a compressor control loop in which the compressors Nos. 1 to 3 are sequentially controlled in an endless manner, and a capacity control loop in which the valves $V_{11}$ and $V_{12}$ of three compressors are controlled sequentially and in an endless manner.

Briefly, this conventional controlling operation is as follows. In the capacity control loop, when the discharge pressure comes down below the on-loading instruction set level $L_1$, the valve which has been kept in the unloaded state longest is put into operation, i.e., into the on-loaded state. Conversely, when the discharge pressure has been increased to a level exceeding the unloading instruction level $H_1$, the valve which has been kept in the on-loaded state longest is turned to the unloaded state. The compressor control loop operates in the same way. Namely, when the discharge pressure is reduced to a level below the starting instruction set level $L_2$, the compressor which has been out of operation longest is put into operation, whereas, when the discharge pressure is increased beyond the stopping instruction set level $H_2$, the compressor which has worked longest is stopped.

Figure 7:
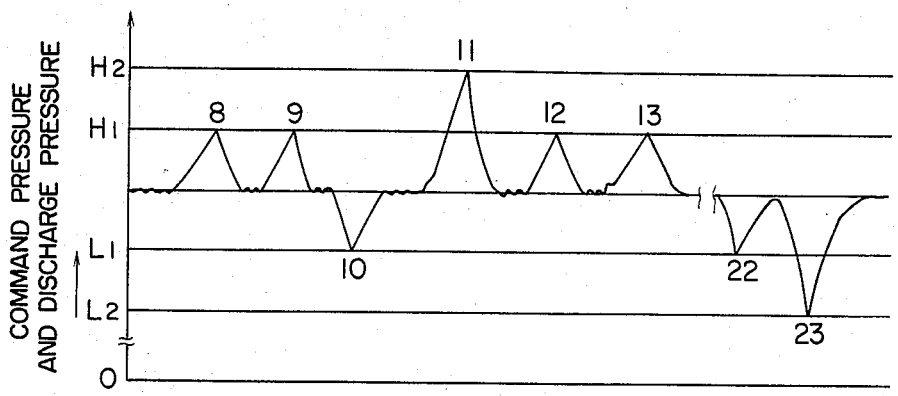
FIG. 7 is a chart showing the relationship between the command control pressure and the discharge pressure in the operation mode as shown in FIG. 6.
Figure 10:
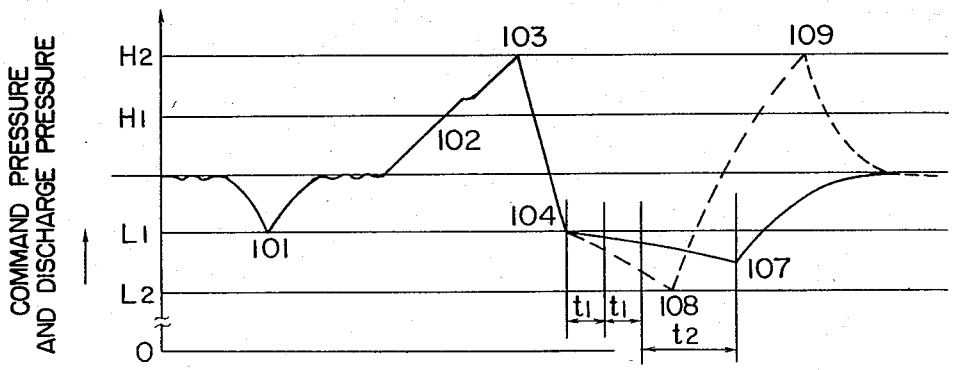
FIG. 10 PRIOR ART
FIG. 10 is a chart showing the relationship between the command control pressure and the discharge pressure in the control mode shown in FIG. 9

The modes of operation in accordance with the above-explained conventional controlling method are shown in FIGS. 9 and 10, respectively, which correspond to FIGS. 6 and 7 illustrating the operation in accordance with the controlling method of the invention. Referring to FIG. 9, the operation is commenced in a mode 1 and the compressor No. 1 starts to operate with the discharge pressure below the starting instruction set level $L_2$. Subsequently, the valve $V_{11}$ is turned to the on-loaded state so that the compressor operates with 50% capacity. However, since the discharge rate is smaller than the load demand, the operation mode is changed to a mode 2 so that the valve $V_{12}$ is turned to the on-loaded state because the discharge pressure is below the on-load instruction set level $L_1$. As the load demand is increased from this state, the compressor No. 1 can no longer meet the load demand so that the discharge pressure is reduced below the starting instruction set level $L_2$. Then, the compressor No. 2 is started in the next mode 3. The operation is then continued with varying modes down to a mode 100, following, each change in the load demand. After the control operation of the mode 100, it is assumed here that the valve $V_{12}$ of the compressor No. 1 has been kept in the unloaded state longer than the valve $V_{12}$ of the compressor No. 3. When the discharge pressure is reduced down below the on-load instruction set level $L_1$, the valve $V_{12}$ of the compressor No. 1 is turned to the on-loaded state so that the operation mode is change to the next mode 101. Then, as the discharge pressure is increased to a level exceeding the set level $H_1$, the operation mode is changed to a mode 102. A further increase of the discharge pressure up to the set level $H_2$ makes the automatic control system stop the compressor No. 1 which is the one worked longest, as shown in mode 103.

According to this controlling method, the compressor in some cases is stopped while it is in the on-load state as in the case of the operation mode 103. In such a case, the load demand exceeds the total discharge rate by an amount corresponding to the full capacity of one compressor. As a result, the discharge pressure is instantaneously decreased from the state of mode 103 in FIG. 10 to the state of mode 104. Consequently, the valve $V_{12}$ of the compressor No. 3 is turned to the on-loaded state as shown in the column of mode 104 in FIG. 9 so that the decrease of the discharge pressure is made more gentle as compared with the reduction down to the mode 104 in FIG. 10. In this state, however, the compressor system still has a shortfall of discharge pressure by an amount corresponding to about 50% of the discharge rate of one compressor. Since the control is made sequentially, the on-loading instruction is delivered to the valve $V_{11}$ of the compressor No. 2, skipping mode 105 and 106 of the valves $V_{11}$ and $V_{12}$ of the compressor No. 1, which has been stopped, thus requiring the skipping time $t_1$. On condition that the on-loading effect confirmation period $t_2$ has expired, the valve $V_{12}$ of the compressor No. 2 is turned to the onloaded state as shown in the column of mode 107, so that the discharge pressure is gradually recovered.

However, if the discharge pressure is decreased to the starting instruction set level $L_2$ within the period of $(t_1+t_1+t_2)$ in which the recovery of the discharge pressure is made from the mode 104 shown in FIG. 10, a mode 108 is commenced to restart the compressor No. 1. In this state, too many compressors have been put into operation, so that the discharge pressure is increased to the state of a mode 109 shown in FIG. 10. Consequently, the compressor No. 2 is stopped, as in the mode 109 shown in FIG. 9, so that the discharge rate comes to equal the load demand. Thus, the conventional controlling method is liable to cause a hunting of the control system due to the lack of communication between the compressor controlling loop and the capacity controlling loop.

In the event that the discharge pressure is decreased down to the set level $L_2$ during the change of operation mode from the mode 104 to the mode 107, the compressor No. 1 is restarted unnecessarily which causes hunting of the control system as explained above. This problem would be overcome by shortening the on-loading effect confirmation period because such a shortened period would minimize the possibility of the re-starting of the compressor. This countermeasure, however, brings about the following problem. Namely, the change of operation mode from the mode 8 to the mode 9 shown in FIG. 9 requires only one valve $V_{11}$ to be operated, if the on-loading effect confirmation period has a proper time length. However, if this period is shortened, and additional valve $V_{12}$ is turned to the on-loaded state before the discharge pressure is recovered as a result of the operation of the first valve. That is, the number of the valves in the on-loaded state is unnecessarily large which increases the tendency to also cause hunting of the control system.

According to the controlling method of the invention, the compressor due to be stopped first has already been unloaded before it is actually stopped as in the case of the mode 103 mentioned above. Consequently, the compressor can be stopped without causing any drastic change in the discharge pressure of the compressor system. When the discharge pressure has come down below the set level $L_2$ in the state of the mode 104, the valve $V_{11}$ of the compressor No. 2 is first turned to the on-loaded state and then the compressor which has been out of operation longest is put into operation. With this method, therefore, the excess or shortfall of the discharge rate with respect to the varying load demand is minimized to effectively suppress the hunting of the control system. In addition, unnecessary operation of the compressors is minimized to prolong the life of the compressors and the capacity controllers. Furthermore, since the compressor which has worked longest is preferentially stopped, the lives of all compressors are substantially equalized. Although the invention has been described through its preferred form, it is to be noted here that the described embodiment is not exclusive and various changes and modifications may be imparted thereto without departing from the scope of the invention which is limited solely by the appended claims.

What is claimed is:

1. A method of controlling the operation of a plurality of compressors each having at least one capacity controller capable of changing the discharge rate of the compressor in a stepped manner in such a manner as to provide a total discharge rate just meeting a load demand which varies momentarily, said method comprising the steps of:

(a) setting command control pressure, detecting a discharge pressure of the compressors, and comparing the same with said command control pressure;

(b) sequentially starting the compressors and the capacity controllers in accordance with the result of the comparison and measuring a time duration of operation of each compressor and capacity controller; and (c) controlling the operation of said compressors and said capacity controllers, said controlling step including:

(i) sequentially stopping, when the load is decreasing, the capacity controllers preferentially from those of the compressor which has worked longest among the compressors in such a sequence that the capacity controller which has worked longest is stopped first and, when the load further decreases thereafter, the compressors in such a sequence that the compressor which has worked longest is stopped first; and (ii) sequentially starting, when the load is increasing, the capacity controllers preferentially from those of the compressors other than the compressor which has worked longest in such a sequence that the capacity controller which has been stopped longest is started first and, when the load further increases, the compressors in such a sequence that the compressor which has been stopped longest is started first.

2. A method according to claim 1, further comprising, in order to observe the state of recovery of the discharge pressure as a result of the control of said compressors and said capacity controllers, the steps of setting a predetermined time difference between timing of commencement of the same kind of operation of the same kind of equipment, starting the measurement of the time difference from the commencement of each equipment and, after the measurement of the time difference is finished holding the measurement in a stand-by condition with the time difference elapsed.

3. A method according to claim 1, further comprising the step of, when the compressor which has been stopped longest is started in response to an increase in the load, stopping the capacity controller which has worked longest in the compressor which has worked longest in order to avoid any drastic increase in the discharge pressure.

4. A method according to claim 1, further comprising the step of setting said control command pressure at each of a level for starting said capacity controllers, a level for stopping the capacity controller, a level for starting the compressor and a level for stopping the compressor.

5. An apparatus for controlling the operation of a plurality of compressors each having at least one capacity controller capable of changing a discharge rate of the compressor in a stepped manner in such a manner as to provide a total discharge rate just meeting the load demand which varies momentarily, said apparatus comprising:

a setting/comparing means for setting control command pressure, detecting a discharge pressure of the compressors, and comparing the same with said control command pressure;

starting and measuring means for sequentially starting the compressors and the capacity controllers in accordance with the result of the comparison and measuring a time duration of operation of each compressor and capacity controller; and controlling means for controlling the operation of said compressors and said capacity controllers such as to sequentially stop, when the load is decreasing, the capacity controllers preferentially from those of the compressor which has worked longest among the compressors in such a sequence that the capacity controller which has worked longest is stopped first and, when the load further decreases thereafter, the compressors in such a sequence that the compressor which has worked longest is stopped first, and to sequentially start, when the load is increasing, the capacity controllers preferentially from those of the compressors other than the compressor which has worked longest in such a sequence that the capacity controller which has been stopped longest is started first and, when the load further increases, the compressors in such a sequence that the compressor which has been stopped longest is started first.

6. An apparatus according to claim 5, further comprising, in order to observe the state of recovery of the discharge pressure as a result of the control of said compressors and said capacity controllers, means for setting a predetermined time difference between timings of commencement of the same kind of operation of the same kind of equipment, and means for starting the time difference from the commencement of each equipment and, after the measurement of the time difference is finished, holding the measurement in a stand-by condition with the time difference elapsed.

7. An apparatus according to claim 5, further comprising a means for stopping, when the compressor which has been stopped longest is started in response to an increase in the load, the capacity controller which has worked longest in the compressor which has worked longest in order to avoid any drastic increase in the discharge pressure.

* * * * *